United States Patent [19]

Kojima et al.

[11] 3,940,659

[45] Feb. 24, 1976

[54] DISCHARGE DEVICE CONTROL CIRCUIT INCLUDING A THYRISTOR

[75] Inventors: Suzuo Kojima; Yoshio Fujimaru, both of Itami, Japan

[73] Assignee: Mitsubishi Denki Kabushiki Kaisha, Japan

[22] Filed: Jan. 30, 1974

[21] Appl. No.: 437,788

[30] Foreign Application Priority Data

Jan. 31, 1973 Japan ..... 48-12671

[52] U.S. Cl. ..... 315/241 P; 307/252 M; 315/151; 315/179; 315/188

[51] Int. Cl.[2] ..... H05B 41/32

[58] Field of Search ..... 307/252 M; 315/149, 151, 315/156, 159, 241 R, 241 P, 241 S, 179, 180, 181, 188, 190, 193; 354/129, 145

[56] References Cited

UNITED STATES PATENTS

| | | | |
|---|---|---|---|
| 3,629,673 | 12/1971 | Thorborg | 307/252 M X |
| 3,659,119 | 4/1972 | Kasama et al. | 307/252 M |
| 3,696,268 | 10/1972 | Exner | 315/151 |
| 3,740,610 | 6/1973 | Roncke | 315/241 P |
| 3,809,951 | 5/1974 | Vital et al. | 315/149 |
| 3,849,703 | 11/1974 | Shimamura et al. | 315/241 P |

*Primary Examiner*—Archie R. Borchelt
*Assistant Examiner*—E. R. LaRoche
*Attorney, Agent, or Firm*—Robert E. Burns; Emmanuel J. Lobato; Bruce L. Adams

[57] ABSTRACT

A main capacitor is connected across a series combination of a flash discharge lamp and a thyristor to flash the flash discharge lamp through the thyristor in its ON state. A commutation circuit connected to the thyristor includes a commutation capacitor and another thyristor turned on upon a flashing light from the flash discharge lamp reaching a predetermined magnitude. When turned on, the latter thyristor permits the commutation capacitor to supply a reverse voltage to the first thyristor to turn it off. A semiconductor diode is connected between the commutation capacitor and the first thyristor to prevent that capacitor from applying a forward voltage to the first thyristor.

7 Claims, 2 Drawing Figures

DISCHARGE DEVICE CONTROL CIRCUIT INCLUDING A THYRISTOR

BACKGROUND OF THE INVENTION

This invention relates to a control device for controlling a thyristor operatively coupled to an electric discharge device such as a flash discharge lamp, and more particularly to a control device effective for preventing the permanent breakdown of such a thyristor.

It has been already known to use thyristors to control the energy of flashing light emitted by flash discharge lamps. The thyristor is operative to permit the associated flash discharge lamp to emit a flashing light for a time interval between a time point at which the thyristor is turned on and a time point at which it is turned off so that the energy of flashing light from the flash discharge lamp can be controlled by changing the ON time period of the thyristor. Also there have been previously proposed attempts to automatically control the energy of flashing light from flash discharge lamps to a predetermined magnitude. Such flash discharge lamps are principally used as stroboscopic tubes for use with photographic cameras.

That thyristor controlling such a flash discharge lamp is serially connected to the flash discharge lamp and includes an ignition circuit for bringing it into its ON state and a commutation circuit for resetting it to its OFF state. The commutation circuit has usually a commutation capacitor connected to the thyristor to apply a reverse voltage to the thyristor dependent upon an electrical charge accumulated thereon when the thyristor is to be reset to its OFF state. After having applied to the reverse voltage to the thyristor, the commutation capacitor is charged with the opposite polarity. Thyristors are generally transferred to their OFF state in response to the application of the reverse voltage thereto but a transient state exists until the thyristors are completely returned back to their OFF state. In that transient state the thyristors are apparently in their OFF state but they can readily be turned on. If, in the transient state, a thyristor is again turned on to permit the associated commutation capacitor charged with the opposite polarity to flow a discharge current through the conducting thyristor, then the thyristor may frequently permanently breakdown so that the thyristor is always conducting across the anode and cathode electrodes thereof.

SUMMARY OF THE INVENTION

Accordingly it is an object of the present invention to provide a new and improved control circuit for controlling a thyristor operatively coupled to an electric discharge device, capable of preventing the thyristor from being permanently broken down as above described.

The present invention accomplishes this object by the provision of a control circuit including a thyristor, comprising, in combination, electric discharge device, a thyristor serially connected to the electric discharge means to cause a current flowing the electric discharge device to flow therethrough in the ON state thereof, a commutation circuit including a commutation capacitor and a switching element for controlling the discharge from the commutation capacitor, the switching element being operative to be turned on to discharge an electrical charge with a predetermined polarity accumulated on the commutation capacitor to supply a reverse voltage to the thyristor, and a semiconductor diode connected between the thyristor and the commutation to capacitor prevent an electrical charge with the reverse polarity accumulated on the commutation capacitor from discharging through the thyristor.

BRIEF DESCRIPTION OF THE DRAWING

The present invention will become more readily apparent from the following detailed description taken in conjunction with the accompanying drawing in which.

DESCRIPTION OF THE PREFERRED EMBODIMENTS

Figure 1:
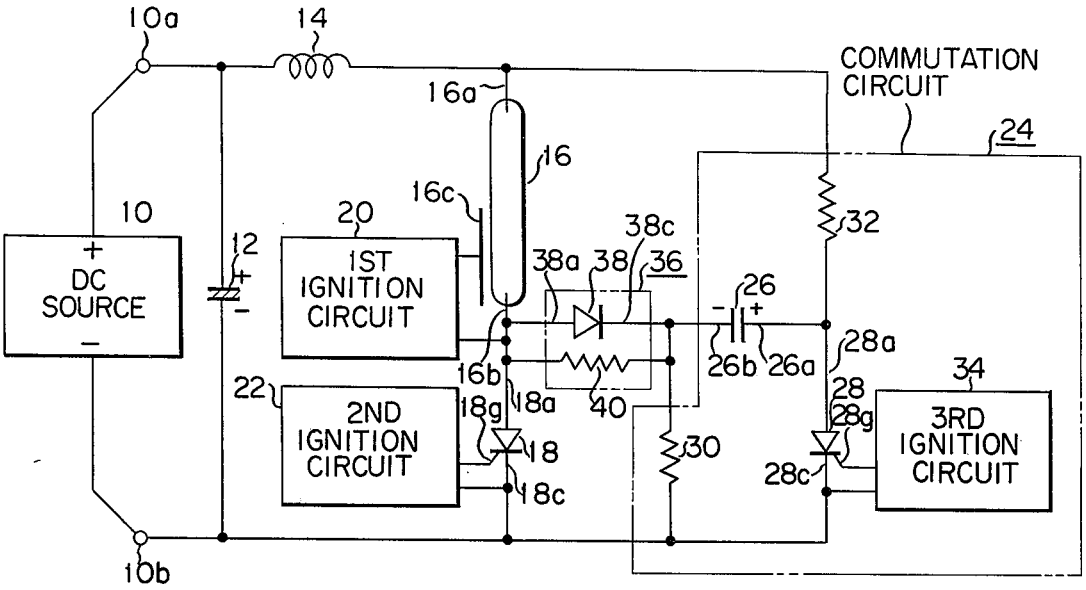
FIG. 1 is a circuit diagram of a control circuit for controlling a thyristor operatively coupled to an electric discharge device in accordance with the principles of the present invention.

Referring now to FIG. 1 of the drawing, there is illustrated a control device for a thyristor constructed in accordance with the principles of the present invention. The control device is adapted to control a thyristor operatively coupled to a flash discharge lamp used in conjunction with a photographic camera and more particularly to automatically adjust an energy of flashing light from the flash discharge lamp to predetermined magnitude. Such a control device may be called a stroboscopic device of automatic emission controlled type.

The arrangement illustrated comprises a source 10 of direct current including a pair of source terminals 10*a* and 10*b* connected to a positive and a negative side of the source 10 respectively. The source 10 may be any of various sources of direct current having normally a voltage of hundreds volts, in this case, of 330 volts.

The source terminals 10*a* and 10*b* have connected thereacross a main capacitor 12 for accumulating an electrical energy for a flashing light. The capacitor 12 has a capacitance normally ranging from 450 to 2,000 microfarads. In the example illustrated the capacitor 12 has a capacitance of 1,000 microfarads. The capacitor 12 has connected thereacross a series circuit including a reactor or inductor 14, an electric discharge device shown as a flash discharge lamp 16 and a thyristor 18 interconnected in the named order. The electric discharge lamp 16 may be a xenon discharge lamp and includes a pair of main electrodes 16*a* and 16*b* and a triggering electrode 16*c*. The triggering electrode 16*c* is disposed adjacent one of the main electrodes 16*b* and has an ability to trigger a light emission of the lamp 16. The main electrode 16*a* is connected to one side of the main capacitor 12 through the reactor 14 while the main electrode 16*b* is connected to the other side of the main capacitor 12 through the thyristor 18.

The thyristor 18 may be a two or three terminal thyristor having a four layer structure of PNPN conductivity type or a two or three terminal bidirectional thyristor having a five layer structure of alternate conductivity type. In the embodiment illustrated it is assumed that the thyristor 18 is a three terminal thyristor having the four layer structure. The thyristor 18 includes an anode electrode 18*a* connected to the main electrode 16*b* of the flash discharge lamp 16, a cathode electrode 18*c* connected to the other side of the capacitor 12, and a gate electrode 18*g*.

A first ignition circuit schematically shown at block 20 is connected across the main and triggering electrodes 16*b* and 16*c* of the discharge lamp 16. The ignition circuit 20 is of the well known construction and adapted to be driven by an X contact interlocking with a shutter of the associated photographic camera although such components are not illustrated. The release of the shutter causes the first ignition circuit 20 to supply an ignition voltage across the triggering and main electrodes 16*c* and 16*b* of the flash discharge lamp 16 sufficient to initiate an electric discharge across the main lamp electrodes 16*a* and 16*b*.

A second ignition circuit also schematically shown of block 22 is connected across the gate and cathode electrodes 18*g* and 18*b* of the thyristor 18. The second ignition circuit 22 is also of the well known construction and identical in operation to the first ignition circuit 20. That is, the circuit 22 responds to the release of the associated camera's shutter to supply a triggering voltage across the triggering electrode 18*g* and cathode electrode 18*c* of the thyristor 18 to bring the thyristor into its conducting or ON state. The voltages supplied from the circuits 20 and 22 are in the form of pulses disappearing after an extremely short time intervals.

In order to turn the thyristor 18 off, the thyristor 18 has operatively associated therewith a commutation circuit generally designated by the reference numeral 24. The commutation circuit 24 include a commutation capacitor 26 and a switching element 28 connected across the capacitor 26 through a fixed resistor 30. Another fixed resistor 32 is connected between the junction of the capacitor 26 and the switching element 28 and the main electrode 16*a* of the flash discharge lamp 16. The switching element 28 may be any of a thyristor, a vacuum triode such as a discharge tube, an arrester etc. The switching element 28 is shown in FIG. 1 as being a triode thyristor including an anode electrode 28*a* connected to the junction of the capacitor 26 and the resistor 32, a cathode electrode 28*c* connected to the resistor 30 and also to the cathode electrode 18*c* of the thyristor 18, and a gate electrode 28*g*. The thyristor 28 illustrated has preferably a four layer structure of PNPN conductivity type. The thyristor 28 has a third ignition circuit 34 connected across the gate and cathode electrodes 28*g*. and 28*c* thereof. The third ignition circuit 34 is also of the conventional construction and includes a light receiving element (not shown) for sensing a quantity of flashing light emitted by the flash discharge lamp 16 and reflected from the particular object (not shown). Upon the light receiving element sensing a predetermined quantity of flashing light, the ignition circuit 34 supplies an ignition pulse across the gate electrode 28*g* and the cathode electrode 28*c* sufficient to trigger the thyristor 28 to its ON state.

The commutation capacitor 26 is shown in FIG. 1 as having one terminal 26*a* connected to the anode electrode 28*a* of the thyristor 28 and the other terminal 26*b* connected through the resistor 30 to the cathode electrodes 18*c* and 28*c* respectively of the thyristors 18 and 28. The commutation capacitor 26 is considerably less in capacitance than the main capacitor 12 and has preferably a capacitance ranging from 2 to 6 microfarads. In this case, the capacitance of the commutation capacitor 26 is of 5 microfarads.

The fixed resistors 30 and 32 are considerably high in magnitude of resistance and, in this case, of 20 kilohms.

According to the principles of the present invention, a protective circuit generally designated by the reference numeral 36 is connected between the main electrode 16*b* of the flash discharge lamp 16 or the anode electrode 18*a* of the thyristor 18 and the terminal 26*b* of the commuation capacitor 26. The protective circuit 36 includes a semiconductor diode 38 and a fixed resistor 40 connected across the diode 38. The diode 38 has an anode electrode 38*a* connected to the main discharge electrode 16*b* and a cathode electrode 38*c* connected to the capacitor terminal 26*b*. The resistor 40 is relatively low in magnitude of resistance and preferably of hundreds ohms.

The arrangement of FIG. 1 is operated as follows: With a voltage across the source 10 applied across the terminals 10*a* and 10*b*, the main capacitor 12 is charged with the polarity illustrated so that that side thereof connected to the terminal 10*a* is positive with respect to the other side of the capacitor 12. At the same time, the commutation capacitor 26 is initiated to charge from the source 10 through a circuit including the reactor 14, the resistor 32, the capacitor 26 and the resistor 30. Thus the commutation capacitor 26 charges so that the terminal 26*a* is positive with respect to the terminal 26*b* as shown in FIG. 1.

It is assumed that the associated camera's shutter (not shown) is released with the main capacitor 12 charged with the polarity illustrated. Under the assumed condition, the ignition circuits 20 and 22 substantially simultaneously produce respective ignition pulses. The ignition pulse from the ignition circuit 20 is supplied to the flash discharge lamp 16 to trigger it while the ignition pulse from the ignition circuit 22 is supplied to the thyristor 18 to turn it on. The conduction of the thyristor 18 permits the main capacitor 12 to discharge through the reactor 14, the flash discharge lamp 16 and the conducting thyristor 18 to emit a flashing light from the lamp 16. The flashing light thus produced irradiates the particular object (not shown) and when the object is irradiated with a predetermined quantity of light suitable for photographing as determined by a light receiving element (not shown) included in the third ignition circuit 34, the latter circuit 34 produces an ignition pulse. This ignition pulse is applied across the gate electrode 28*g* and cathode electrode 28*c* of the thyristor 28 to trigger this thyristor to its ON state. Therefore an electrical energy with the polarity illustrated charged on the commutation capacitor 26 is supplied, as a reverse voltage, to the thyristor 18 through the conducting thyristor 28 to render the cathode electrode 18*c* positive with respect to the anode electrode 18*a* of the thyristor 18 with the result that the thyristor 18 is transferred from its ON to its OFF state. In this OFF state of the thyristor 18, a discharge current from the main capacitor 12 flows through a circuit traced therefrom through the reactor 14, the flash discharge lamp 16, the diode 38 in the protective circuit 36, the commutation capacitor 26 and the thyristor 28 and thence to the capacitor 12. The discharge current charges the commutation capacitor 26 with the polarity reversed from that illustrated. That is, its terminal 26*b* becomes positive with respect to its terminal 26*a*. However, the capacitor 26 is immediately charged up with the reverse polarity because of the low capacitance thereof. Therefore the flash discharge lamp 16 is interrupted to emit the flashing light simultaneously with the charging up of the reverse polarity of the commutation capacitor 26.

A time interval starting with the application of an ignition pulse from the ignition circuit 34 to the thyristor 28 and ending at the interruption of a flashing of the discharge lamp 16 is very short and remains substantially unchanged independently of a predetermined quantity of flashing light set by the third ignition circuit 34. Thus a quantity of flashing light from the flash discharge lamp 16 is substantially proportional to a time interval between a time point at which each ignition pulse is applied to the thyristor 16 and a time point at which an ignition pulse is then applied to the thyristor 28. This results in the automatic control of a quantity of flashing light emitted by the flash discharge lamp 16.

After the commutation capacitor 26 has been charged with the reverse polarity, a discharge current from the main capacitor 12 tends to flow through the reactor 14 and the resistor 32 to the thyristor 28. Since the resistor 32 is sufficiently high in the magnitude of resistance, that current flowing to the thyristor 28 is decreased to less than a magnitude of a self-holding current for the thyristor 28 thereby to reset the latter to its OFF state. Actually the current scarcely flows through the thyristor 28. In this way one complete cycle of the operation has ended and the arrangement of FIG. 1 is ready for the succeeding operation.

For a better understanding of the operation of the protective circuit 36, the process of transferring the thyristor 18 from its ON to its OFF state, will now be in detail described. As above described, the thyristor 18 has the structure including four layers or P, N, P and N layers. Thus it includes three P-N junctions between those layers. When the commutation capacitor 26 applies a reverse voltage to the thyristor 18, the latter is transferred from its ON to its OFF state. However the thyristor 18 is in its transient state until it is completely brought into its OFF state. More specifically, a reverse voltage applied to the thyristor 18 serves to reversely bias the two outer P-N junctions to externally conduct the residual carriers adjacent these junctions. Therefore the thyristor 18 is apparently put in its OFF state, but the same reverse voltage serves to forwardly bias the central P-N junction. Accordingly, the residual carriers adjacent the central junction disappear only through the recombination thereof without externally conducting the residual carriers. Thus some time period is taken until all the residual carriers are extinguished. After this time period the transient state as above described terminates and the thyristor 18 is completely brought into its OFF state. In the transient state the thyristor 18 has a tendency to be again turned on. For example, if the reverse voltage is not sufficiently high in magnitude and a great number of the residual carriers remain then the thyristor 18 may be again turned on in response to a forward voltage with a very low magnitude applied across the anode and cathode electrodes thereof. Also, the thyristor 18 may be again brought into its ON state by applying thereto an ignition pulse though it would be very low. It is not desirable that the thyristor 18 is again brought into its ON state in such a transient state.

It has been recalled that the commutation capacitor 26 is charged with the polarity reversed from that illustrated after a reverse voltage has been applied to the thyristor 18. In other words, there is such a temporal relationship that the thyristor 18 is in the transient state while the commutation capacitor 26 is charged with the reverse polarity. If the thyristor 18 in the transient state is again turned on to permit a discharge current from the commutation capacitor 26 to flow into that thyristor, then the current rushes in the thyristor 18 to cause an excessive current to flow through the latter resulting in the occurrence of the permanent breakdown that the thyristor 18 is permanently shortcircuited between the anode and cathode electrodes 18*a* and 18*c* thereof.

According to the present invention, the protective circuit 36 and more particularly the diode 38 functions to prevent an excessive discharge current from the commutation capacitor 26 from flowing into the thyristor 18, thereby to protect the thyristor 18 against the permanent breakdown. When the thyristor 18 is again turned on, the main capacitor 12 tends to supply a discharged current to the thyristor 18 through the reactor 14 and the flash discharge lamp 16. But the reactor 14 limits this discharge current to an extent ensuring that the thyristor 18 is prevented from being permanently broken down.

Now, it is frequently difficult to avoid the retransferring of the thyristor 18 to its ON state while in its transient state. Firstly, when the flash discharge lamp 16 is caused to repeatedly emit flashing light in a short period, a time interval for which the commutation capacitor 26 is charged with the polarity illustrated is inevitably shortened resulting in a reverse voltage of deficient magnitude being applied to the thyristor 18. If the reverse voltage is deficient in magnitude, then the thyristor 18 is apt to be again turned on because the lamp 16 is still discharging thereby to apply a forward voltage across the thyristor 18 immediately after a reverse voltage has been applied to the thyristor 18. This is liable to occur in the case the associated photographic camera is driven by an electric motor to emit light twice or thrice for one second. Secondly, the undesirable ignition signal as above described could be frequently produced with the stroboscopic tube operatively coupled to photographic cameras. For example, the test pushbutton usually disposed on photographic cameras to test the emission from the flash discharge lamp 16 is adapted to cause the ignition circuits 20 and 22 to produce ignition signals as does the mating camera's shutter. The test pushbutton is apt to chatter in view of the standpoint of its mechanism so that the undesirable ignition pulses as above described may be produced following the required ignition signal. In addition, photographic cameras usually include the electric circuitry of complicated configuration for the purpose of miniaturizing the circuitry. This can often cause undesirable ignition signals through the electromagnetic induction developed in the circuitry.

When the thyristor 28 has been first turned on, the resistor 40 connected across the diode 38, along with the resistor 32, the capacitor 26, and the now conducting thyristor 18, forms a circuit promoting the charging of the capacitor 16 with the polarity illustrated. This is effective for increasing a reverse voltage applied to the thyristor 18 in the case the flash discharge lamp 16 is caused to repeatedly emit light in a short period. However, the resistor 40 may be omitted, if desired.

Figure 2:
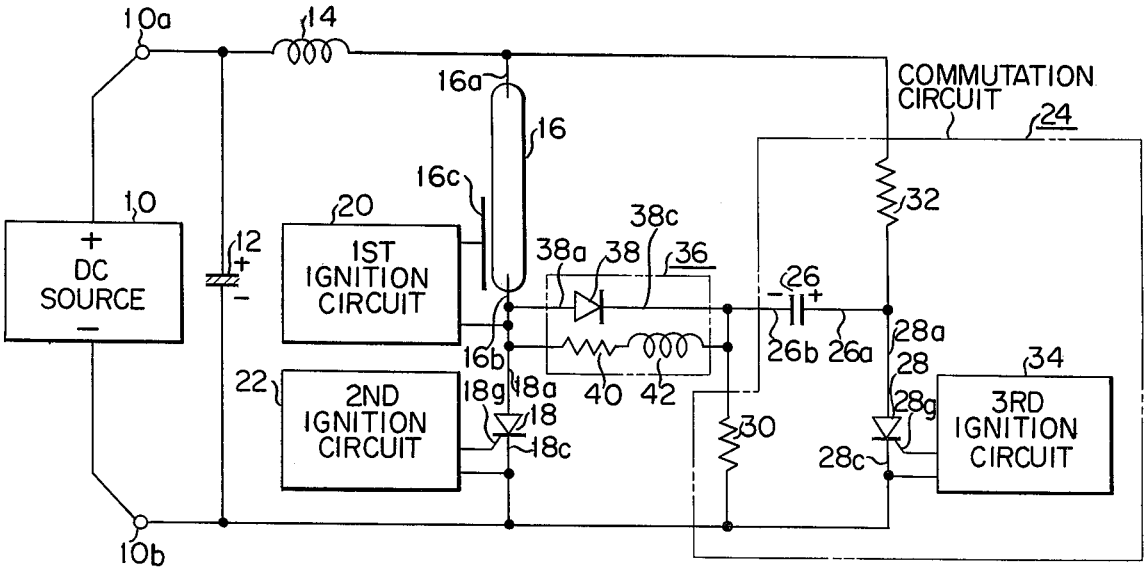
FIG. 2 is a circuit diagram of a modification of the present invention.

FIG. 2 wherein like reference numerals designate the components identical to those shown in FIG. 1 illustrates a modification of the present invention. The arrangement illustrated is identical to that shown in FIG. 1 except for a reactor 42 being serially connected to the resistor 40. The reactor 42 serves to protect the thyristor 18 by suppressing a rise of a reverse current flowing from the cathode to the anode electrode of the thyristor 18 due to a charge with the illustrated polarity on the commutation capacitor 26 supplied, as a reverse voltage, to the thyristor 18.

The flash discharge lamp 16 may be replaced by a series combination of a triode thyristor having a four layer structure of PNPN conductivity type and a resistor. The series combination forms an electric element electrically equivalent to the flash discharge lamp 16. The thyristor in this case has, of course, the ignition circuit 20 connected across the gate and cathode electrodes thereof and the source terminal 10*a* connected to the anode electrode thereof through the reactor 14. The arrangement as shown in FIGS. 1 and 2, having the series combination of thyristor and resistor substituted for the flash discharge lamp 16 is effectively used as a test circuit for testing the turning on and off of the thyristor 18 as a thyristor to be tested. The protective circuit 34 is also effective for preventing the thyristor being tested from being permanently broken down because if the tested thyristor is permanently broken down then their value as the product is fully lost.

While the present invention has been illustrated and described in conjunction with a few preferred embodiments thereof it is to be understood that various changes and modification may be resorted to without departing from the spirit and scope of the present invention. For example, the present invention is equally applicable to the thyristor 18 composed of a diode thyristor having a four layer structure of PNPN conductivity type, or a two or three terminal thyristor having a five layer structure of alternate conductivity type. This is because the transient state is present in those thyristors upon transferring them from their ON to their OFF state.

What we claim is:

1. A control circuit for controlling an electric discharge device, comprising, in combination:

a first circuit branch comprising an electric discharge device and a thyristor connected in series with said discharge device for controlling current flowing through said discharge device and flowing through the node at which said discharge device and said thyristor are connected;

a second circuit branch connected in parallel with said first circuit branch, said second circuit branch comprising an impedance element connected to said discharge device and a switching element connected to said thyristor and to said impedance element to define a node therewith; and a third circuit branch connected between the node defined by said discharge device and said thyristor and the node defined by said impedance element and said switching element, said third circuit branch comprising a commutation capacitor for storing and applying a reverse voltage to said thyristor under control of said switching element to bias said thyristor from a conducting to a nonconducting state, and a diode connected in series with said commutation capacitor and having a polarity effective to prevent a voltage opposite the polarity of said reverse voltage and stored on said commutation capacitor from being applied to said thyristor.

2. A control circuit for a discharge device as claimed in claim 1, wherein said electric discharge device comprises a series combination of a thyristor and a resistor.

3. A control circuit for a discharge device as claimed in claim 1, wherein said electric discharge device is a flash discharge lamp.

4. A control circuit for a discharge device as claimed in claim 3, further comprising a first ignition circuit connected to said flash discharge lamp and a second ignition circuit connected to said thyristor and wherein said first and second ignition circuits are responsive to the operation of a camera shutter to produce respective ignition signals.

5. A control circuit for a discharge device as claimed in claim 4 wherein said switching element is a second thyristor, and further comprising a third ignition circuit connected to said second thyristor, said third ignition circuit comprising means responsive to a quantity of light emitted from said flash discharge lamp reaching a predetermined magnitude to bias said second thyristor to conduct.

6. A control circuit for a discharge device comprising, in combination: an electric discharge device; a thyristor connected in series with said electric discharge device to control a current flowing through said electric discharge device; a commutation circuit including a commutation capacitor and a switching element for controlling the discharge of said commutation capacitor through said thyristor; said switching element being connected between said thyristor and said commutation capacitor to supply a reverse voltage stored in said commutation capacitor to said thyristor to bias said thyristor from a conductive to a nonconductive state; a semiconductor diode connected between said commutation capacitor and said thyristor to prevent an electrical charge with a polarity opposite that of the reverse voltage accumulated on said commutation capacitor from discharging through said thyristor; and a resistor connected in parallel with said semiconductor diode.

7. A control circuit for a discharge device comprising, in combination: an electric discharge device; a thyristor connected in series with said electric discharge device to control a current flowing through said electric discharge device; a commutation circuit including a commutation capacitor and a switching element for controlling the discharge of said commutation capacitor through said thyristor; said switching element being connected between said thyristor and said commutation capacitor to supply a reverse voltage stored in said commutation capacitor to said thyristor to bias said thyristor from a conductive to a nonconductive state; a semiconductor diode connected between said commutation capacitor and said thyristor to prevent an electrical charge with a polarity opposite that of the reverse voltage accumulated on said commutation capacitor from discharging through said thyristor; and a resistor and a reactor connected in series, and wherein the series combination of said resistor and reactor is connected in parallel with said diode.

* * * * *